US006357261B1

(12) United States Patent
Cheng

(10) Patent No.: US 6,357,261 B1
(45) Date of Patent: Mar. 19, 2002

(54) INVISIBLE CONNECTOR FOR JEWELRY STRAND

(76) Inventor: Howard Cheng, 2821 S. Quinn St., Chicago, IL (US) 60608

( * ) Notice: Subject to any disclaimer, the term of this patent is extended or adjusted under 35 U.S.C. 154(b) by 83 days.

(21) Appl. No.: 09/592,318

(22) Filed: Jun. 13, 2000

(51) Int. Cl.[7] ..... A44C 7/00
(52) U.S. Cl. ..... 63/3.1; 63/3; 24/574.1
(58) Field of Search ..... 63/3, 3.1, 26; 24/574.1

(56) References Cited

U.S. PATENT DOCUMENTS 1,455,933 A * 5/1923 Conway ..... 63/3.1
1,738,371 A * 12/1929 Jenckes ..... 63/3.2
1,795,674 A * 3/1931 Potter ..... 63/3.1
1,936,378 A * 11/1933 Carr ..... 63/3.2
5,720,049 A * 2/1998 Clutton ..... D2/500
5,782,107 A * 7/1998 Glanz ..... 63/3

* cited by examiner

*Primary Examiner*—Anthony Knight
*Assistant Examiner*—E Peavey
(74) *Attorney, Agent, or Firm*—Andrus, Sceales, Starke & Sawall

(57) ABSTRACT

An invisible connector assembly for a beaded strand of jewelry includes solid connector posts mounted in through-bores in the end beads of the strand. One post is provided with a threaded stud extending axially from the bead, and the other post is tapped within the bore of the bead to receive the threaded stud. The opposite end of each connection post is provided with a swiveling eye for connection to one end of the string mounting the remaining beads of the strand.

6 Claims, 1 Drawing Sheet

INVISIBLE CONNECTOR FOR JEWELRY STRAND

BACKGROUND OF THE INVENTION

The present invention relates to an end connector for a strand of jewelry and, in particular, to an invisible connector for a beaded strand of jewelry strung on a common strand.

Beaded jewelry strands, such as a string of pearls, are commonly made by stringing through-bored beads on a common string or strand. The string may comprise any suitable material possessing the necessary strength and flexibility, a single monafilament strand of suitable plastic material often being used. Semi-precious or precious metal connectors or clasps are typically used to connect the strand ends for secure, but reopenable attachment. Such connectors or clasps function in many different ways, but one common characteristic is that they all define a noticeable gap between the end-connected beads in the strand.

Invisible strand connectors have been developed that are not readily apparent when the end beads of the strand are connected and give the appearance of all beads in the strand being joined without a visible connector or clasp. However, such invisible connectors are of delicate construction and, if broken, are difficult and tedious to repair. One prior art type of invisible connector is shown in FIG. 6 and includes mating through-bored posts mounted in bores drilled in the two end beads (e.g., pearls) of a strand. One of the posts 2 is of a smaller diameter and has an extended threaded stud on one end. The other of the posts 3 of larger diameter has a tapped I.D. to receive the threaded stud to interconnect the end beads and thus provide a strand with an apparent invisible connection. Each of the posts is through-bored and has inserted into it one end of connecting string or wire piece 4 that is threaded through a small hole in the opposite end of the post. The ends of the string pieces within the bores are enlarged as by knotting or heading to prevent passage through the small hole. The free ends of the wire pieces are then tied or otherwise secured to the ends of the main strand on which the remaining beads are strung. The most serious problem with this prior art construction is that the posts themselves are very small in diameter (e.g., about 0.08 inch (2 mm) or less) and, after being through-bored for the connecting wires, are extremely weak and susceptible to breakage and consequent tedious and costly repair. Further, the very small through-bores require the use of small diameter wire pieces which tend to be quite weak and susceptible to breaking. Also, removing and replacing the end of the string piece is difficult.

SUMMARY OF THE INVENTION

In accordance with the present invention, an invisible connector for a string of beaded jewelry utilizes a threaded post construction that is far stronger than prior art constructions, yet is easier to repair if broken.

The connector assembly of the present invention is attached to and interconnects the two end beads of a beaded stranded or the like. A first connector post is secured in a through-bore in one of the end beads, the post having a solid body, one end of which has an integral threaded stud that extends outwardly from the bead. A second connector post is secured in a through-bore in the other of the end beads and has an end tapped to receive the threaded stud of the first post. Each of the connector posts is provided on its respective opposite end with an eye that is captured in the post end to swivel on the post axis and to extend outwardly therefrom for connection to one end of the string on which the remaining beads are strung. To provide mounting for the eyes, the opposite unthreaded end of each connector post is provided with a bored ID portion and an end cap that encloses the bore and is provided with a small axial hole extending therethrough. Each eye includes a neck that extends through the hole in the end cap and an anchoring base connected to the opposite end of the neck and captured in the ID bore for swiveling movement therein.

The second connector post has a length substantially equal to the diameter of the bead and is secured therein along its full axial length. Preferably, the body of the second connector beyond the tapped end is substantially solid. However, the body of the second connector may alternately be through-bore.

DETAILED DESCRIPTION OF THE PREFERRED EMBODIMENT

Figure 1:
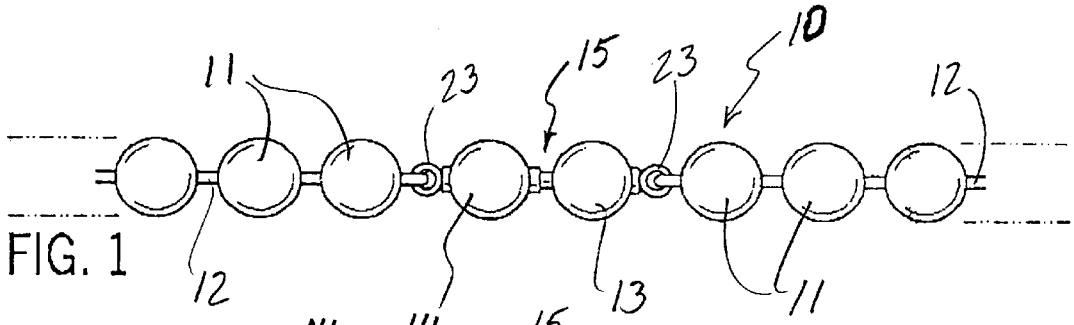
FIG. 1 shows a portion of a beaded strand of jewelry utilizing the invisible connector of the present invention.
Figure 2:
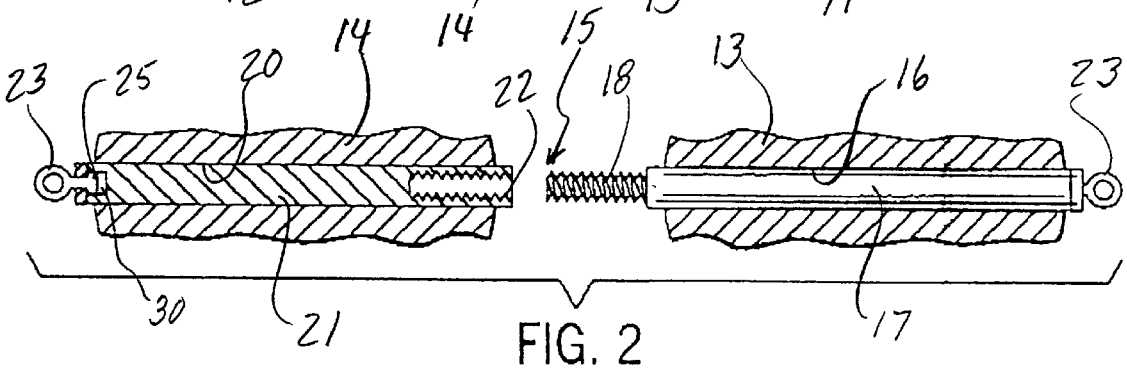
FIG. 2 is an enlarged view, partly in section, showing the two end beads of the strand which mount the components of the connector assembly of the present invention.

In FIG. 1, a strand 10 of beaded jewelry includes a plurality of beads 11, each having a small diametral bore formed therein through which a common flexible string 12 is inserted to form a string or strand of beads. The opposite ends of the strand 10 are defined by first and second end beads 13,14 which together carry the invisible connector assembly 15 of the present invention.

One of the end beads, such as first end bead 13, is provided with a through-bore 16 along its diameter which has a small size, for example 2 mm, but which is typically larger than the bores in the other beads of the strand mounted on the string 12. The through-bore 16 in bead 13 has a solid metal first post 17 inserted therein. The post 17 is preferably made of a precious metal, such as silver or gold alloy. The post has an OD that matches the ID of the through-bore 16 to fit snuggly therein and may be secured in place with a suitable cement or adhesive. One end of the first post 17 is provided with an integral threaded stud 18 that extends axially outwardly beyond the bead 13.

The second end bead 14 is similarly provided with a through-bore 20 within which is secured a second metal post 21. The second post is preferably solid, except for a tapped end 22 adapted to match and receive the threaded stud 18 extending from the first end bead 13. When the threaded stud 18 of the first end bead is threaded into the capped end 22 in the post within the second end bead 14, the two beads may be brought into nearly abutting contact, as shown in FIG. 1.

To prevent undesirable twisting of the strand 10 as the threaded connector is joined, the opposite ends of the connector posts 17,21 are provided with swiveling eyes 23. The eyes 23 provide connection for the ends of the string 12 on which the remaining beads are strung.

Figure 3:
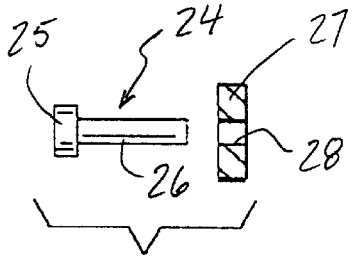
FIGS. 3–5 show the sequence of steps used to manufacture and attach the swivel eyes used with the connector assembly.
Figure 4:
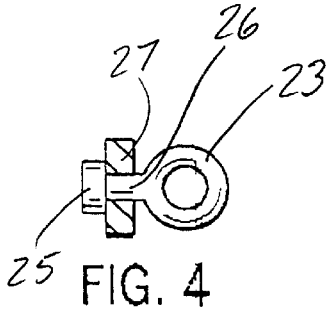
Figure 5:
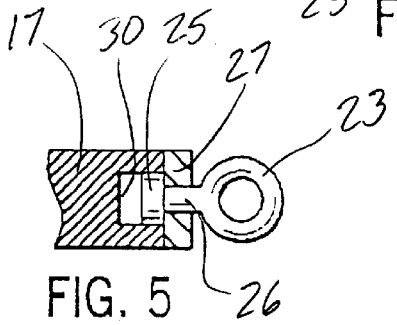
Figure 6:
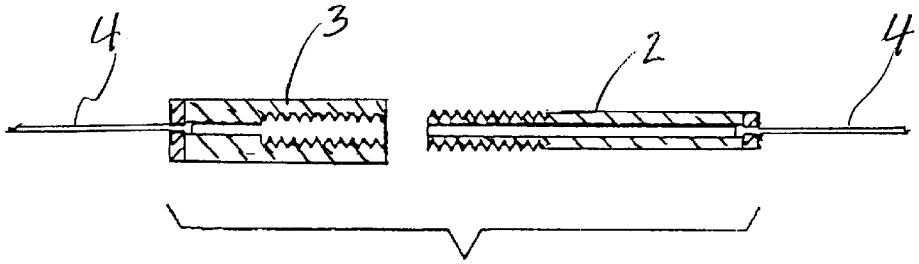
FIG. 6 (PRIOR ART)
FIG. 6 is a sectional detail through an invisible connector assembly of the prior art.

Referring to FIGS. 3–5, each of the eyes 23 is formed and attached to its respective post 17 or 21 in the same manner. A stem piece 24 is formed with enlarged and preferably cylindrical base 25 and a wire-like neck 26. A small annular end cap 27, having a diameter equal to the diameter of the post 17 or 21, is provided with a center hole 23 slightly larger than the diameter of the neck 26 so that neck may pass easily there through. After the neck has been inserted through the hole 28 in the end cap 27, the end of the neck is formed into an eye 23 having a center connecting hole for the string 12 front area.

The end of each post 17,21, opposite the threaded connections, is provided with a shallow counterbore 30 having a diameter slightly larger than the diameter of the stem piece base 25 and an axial depth sufficient to receive the base therein. The end cap 27 is then placed against and soldered to the end of the post defining the perimeter of the counterbore 30. The stem piece is thus captured for swiveling movement on the axis of the post.

To disconnect the beaded strand 10, the end beads 13,14 carrying the connector assembly 15 are easily located by the connecting eyes 23 on their opposite ends. The beads 13,14 may be unscrewed and disconnected without twisting by virtue of relative rotation of the eyes therein. The solid construction of the posts 17,21, which are formed without the through-bores of the prior art, enhance considerably the strength of the connection. Also, the tedious, time-consuming and delicate through-boring of the posts is eliminated.

I claim:

1. A connector assembly for a beaded strand of strung jewelry comprising:

a first connector post secured in a through-bore in one of the end beads of the strand, said first post having a solid body, one end of which has integral threaded stud extending outwardly from said end bead;

a second connector post secured in a through-bore in the other of the end beads of the strand, said second post having one end tapped to receive the threaded stud of said first post; and, each of said connector posts having an eye mounted on the respective opposite end, each eye captured in the post and to swivel on the post axis and extending outwardly from said opposite end for connection to one end of the string on which the remaining beads are strung.

2. A connector assembly as set forth in claim 1 wherein the opposite end of each connector post includes a bored ID and an end cap enclosing said ID bore and having an axial hole extending therethrough, and each eye includes a neck extending through the hole in the end cap and an anchoring base connected to said neck and captured in the bore for swiveling movement therein.

3. A connector assembly as set forth in claim 1 wherein said second connector post is secured along substantially its full axial length in said through-bore.

4. A connector assembly as set forth in claim 1 wherein the body of the second connector beyond said tapped end is substantially solid.

5. A connector assembly for an open strand of jewelry comprising:

a pair of end beads, each having a through-bore in which is secured a solid metal post;

the post in one bore having a threaded end extending beyond the bore;

the post in the other bore having one end tapped to receive said threaded end; and, a swivel connection on the opposite end of each post for attachment to an end of the strand.

6. A connector assembly as set forth in claim 5 wherein each opposite post end is provided with an axial recess enclosed by an apertured end cap, and said swivel connection is anchored in the recess and extends through the aperture in the end cap.

* * * * *